US007409972B2

(12) United States Patent
Haapasalo

(10) Patent No.: US 7,409,972 B2
(45) Date of Patent: Aug. 12, 2008

(54) KNIFE ASSEMBLY FOR A CHIPPER

(75) Inventor: Pauli Haapasalo, Jyväskylä (FI)

(73) Assignee: Rummakko Oy, Jyvaskyla (FI)

( * ) Notice: Subject to any disclaimer, the term of this patent is extended or adjusted under 35 U.S.C. 154(b) by 369 days.

(21) Appl. No.: 10/500,618

(22) PCT Filed: Feb. 13, 2003

(86) PCT No.: PCT/FI03/00111

§ 371 (c)(1),
(2), (4) Date: Jul. 1, 2004

(87) PCT Pub. No.: WO03/068467

PCT Pub. Date: Aug. 21, 2003

(65) Prior Publication Data

US 2005/0081956 A1 Apr. 21, 2005

(30) Foreign Application Priority Data

Feb. 15, 2002 (FI) ..... 20025006

(51) Int. Cl.
*B27C 1/00* (2006.01)

(52) U.S. Cl. ..... 144/174; 144/176; 144/230; 407/37

(58) Field of Classification Search ..... 144/172, 144/174, 176, 162.1, 218, 230, 231; 241/92, 241/294; 407/36, 37, 40, 41, 46, 47
See application file for complete search history.

(56) References Cited

U.S. PATENT DOCUMENTS

| | | | | |
|---|---|---|---|---|
| 4,669,516 | A * | 6/1987 | Carpenter et al. | 144/241 |
| 4,771,718 | A | 9/1988 | Carpenter et al. | |
| 5,271,442 | A * | 12/1993 | Carpenter et al. | 144/220 |
| 5,564,967 | A * | 10/1996 | Jorgensen | 451/45 |
| 5,996,655 | A | 12/1999 | Cramond et al. | |
| 6,722,595 | B1 * | 4/2004 | Frick et al. | 241/92 |

FOREIGN PATENT DOCUMENTS

DE 100 00 330 A1 7/2001

* cited by examiner

*Primary Examiner*—Shelley Self
(74) *Attorney, Agent, or Firm*—Fildes & Outland, P.C.

(57) ABSTRACT

A knife assembly for a chipper, which is intended to be installed in the knife frame includes a counter knife, a reversible knife including two cutting bevel edges, and a clamp. In addition, the knife assembly includes securing devices for securing the clamp and at least one locking piece running parallel to the longitudinal axis of the reversible knife to prevent lateral movement of the reversible knife relative to the counter knife. The reversible knife, the counter knife, and the locking piece are arranged in such a way that the position of the reversible knife relative to the knife frame can be set as desired. The locking piece is also arranged to form a fixed part of the reversible knife or the counter knife, and the counter knife is fitted to the knife frame using shape-locking.

9 Claims, 4 Drawing Sheets

KNIFE ASSEMBLY FOR A CHIPPER

TECHNICAL FIELD

The present invention relates to a knife assembly for a chipper, which is intended to be installed in the knife frame forming part of the chipper, and which knife assembly includes

- a counter knife fitted to the knife frame,
- an essentially symmetrical reversible knife set against the counter knife, at the opposite sides of which there are two cutting bevel edges, one of which cutting bevel edges extends further than the counter knife from the knife frame,
- a clamp, which is arranged to press on the reversible knife from the opposite side than the counter knife,
- securing means for securing the clamp and tightening it onto the knife frame and thus for pressing the reversible knife between the clamp and the counter knife, and
- at least one locking piece, which runs parallel to the longitudinal axis of the reversible knife and which extends on both sides of the boundary surface between the reversible knife and the counter knife, in order to prevent lateral movement of the reversible knife relative to the counter knife, in which knife assembly the reversible knife, the counter knife, and the locking piece are arranged in such a way that the position of the reversible knife relative to the knife frame can be set as desired in the lateral direction of the reversible knife.

BACKGROUND OF THE INVENTION

U.S. Pat. No. 5,409,047 discloses a chipper knife assembly, in which a reversible knife is used. In order to support the reversible knife, the knife assembly includes a clamp and a counter knife, between which the reversible knife is pressed. In a known manner, there are two opposite cutting bevel edges, making it possible to set the reversible knife in the knife assembly in two different ways. The material of the reversible knife can thus be utilized as efficiently as possible. In the said patent, an attempt has been made to improve efficiency by arranging the reversible knife so that it can be sharpened. For this purpose, a key, as a locking piece, is arranged between the counter knife and the reversible knife, to prevent the lateral movement of the reversible knife relative to the counter knife. In other words, the key holds the reversible knife in place against the shear force. The reversible knife has a groove for the key. Correspondingly, there are several parallel groves in the counter knife for the key, allowing the position of the reversible knife in relation to the knife frame to be set as desired. The longitudinal grooves in the counter knife for the reversible knife form an adjustment tolerance, within which the reversible knife can be moved. Once there is no longer any sharpening tolerance or aforesaid adjustment tolerance in the reversible knife, the reversible knife is replaced with a new one.

The key used in the disclosed knife assembly is especially thin and thus liable to break. In addition, the key is difficult to position correctly and when fitting the reversible knife the clamp too must be removed. This is because the grooves in the counter knife only cover part of the width of the reversible knife. At the same time, several keys are required for a single reversible knife, making it even more difficult to set the reversible knife. In practice, the counter knife too wears during chipping. However, the disclosed knife assembly uses one and the same counter knife for a long time. In addition, the changing of the counter knife is labourious, as it is attached with screws. Further, the load arising in operation tends to lift the reversible knife and the counter knife. Sawdust then becomes packed between them, bending the knives and reducing the conducting of heat away from the knives. In addition, a most of the load acting on the reversible knife and the counter knife is directed onto the screws that act as the securing means.

SUMMARY OF THE INVENTION

The invention provides a new type of knife assembly for a chipper, which is easier to use than before, but which has a longer life and is thus more economical.

Accordingly, a knife assembly for a chipper, which is intended to be installed in the knife frame forming part of the chipper, and which knife assembly includes

- a counter knife fitted to the knife frame,
- an essentially symmetrical reversible knife set against the counter knife, at the opposite sides of which there are two cutting bevel edges one of which cutting bevel edges extends further than the counter knife from the knife frame,
- a clamp, which is arranged to press on the reversible knife from the opposite side than the counter knife,
- securing means for securing the clamp and tightening it onto the knife frame and thus for pressing the reversible knife between the clamp and the counter knife, and
- at least one locking piece, which runs parallel to the longitudinal axis of the reversible knife and which extends on both sides of the boundary surface between the reversible knife and the counter knife, in order to prevent lateral movement of the reversible knife relative to the counter knife, and which locking piece is arranged to form a fixed part of the reversible knife or the counter knife, in which knife assembly the reversible knife, the counter knife , and the locking piece are arranged in such a way that the position of the reversible knife relative to the knife frame can be set as desired in the lateral direction of the reversible knife, is characterized in that the counter knife has two counter-surfaces arranged to rest on the knife frame, which are arranged to form an acute angle $\alpha$, the size of which is 25-75°, preferably 35-70°, for fitting the counter knife to the knife frame using shape-locking.

The clamp may have two counter-surfaces arranged to rest on the knife frame, which are arranged to form an acute angle $\beta$, the size of which is 40-85°, preferably 45-75°. And the angle between the bisectors of angles $\alpha$ and $\beta$ is a maximum of 20°.

The locking piece may be arranged in the counter knife, a groove corresponding to it being arranged in the reversible knife while the width of the locking piece is the lateral direction of the reversible knife is greater than the height of the locking piece.

The counter knife and the clamp may be arranged to be supported directly on the knife frame.

A counter-knife series for a knife assembly in which knife assembly both cutting bevel edges of the reversible knife are arranged so that they can be sharpened, is characterized in that for each sharpened reversible knife the counter-knife series includes a corresponding counter knife, in order to adapt the position of the sharpened cutting bevel edge relative to the knife frame, to be the same as it was prior to sharpening. The counter-knife series may include 1-6, preferably 2-5 different counter knives for changing the position of the reversible knife by 0.5-1.5 mm, preferably 0.8-1.2 mm in the lateral direction of the reversible knife, after sharpening.

The counter-knife series may include at least one second counter-knife series including a corresponding number of counter knives, in which the angle γ of the counter bevel edge of the counter knives and/or the distance of the cutting bevel edge from the counter bevel edge are different to those in the first counter-knife series.

The counter knives may be precipitation-hardened cast pieces or rolled pieces.

In the knife assembly according to the invention, the changing of the reversible knife is particularly rapid and easy. In addition, the reversible knives can be sharpened many times. Despite sharpening, the cutting bevel edge of the reversible knife can be securely and rapidly set at the desired location. This is achieved through the surprising joint operation of the reversible knife and the counter knife, without separate keys. In addition, the attachment of the counter knife is more secure than before and the counter knife is easier to change. Further, the clamp is supported in the frame in a new way, permitting a higher loading than previously to be imposed on the entire knife assembly. In addition, the support of the clamp and the knife assembly facilitates the correct assembly of the knife assembly and the elimination of loose fits. In addition to this, the reversible knife can be changed by slightly slackening the clamp. Similarly, the reversible knife can be changed without tools. In addition, the knife assembly forms a compact totality and firmly supports the reversible knife.

These and other features and advantages of the invention will be more fully understood from the following detailed description of the invention taken together with the accompanying drawings.

DETAILED DESCRIPTION OF THE DRAWINGS

FIG. 1 shows a cross-section of the knife assembly according to the invention arranged in the knife frame of a chipper, FIG. 2*a* shows a front view of another kind of knife frame of a chipper, equipped with the knife assembly according to the invention, FIG. 2*b* shows a cross-section of the knife frame of FIG. 2*a,*

FIG. 3*a* shows a partial enlargement of FIG. 1,

FIG. 3*b* shows a variation of the knife assembly of FIG. 3*a,*

FIGS. 4*a-d* show cross-sections of a counter-knife series, according to the invention, without a clamp, FIG. 4*e* shows a variation of the counter knife shown in FIGS. 4*a-d.*

FIGS. 4*f-j* show cross-sections of a variation of the counter-knife series according to the invention.

Figure 1:
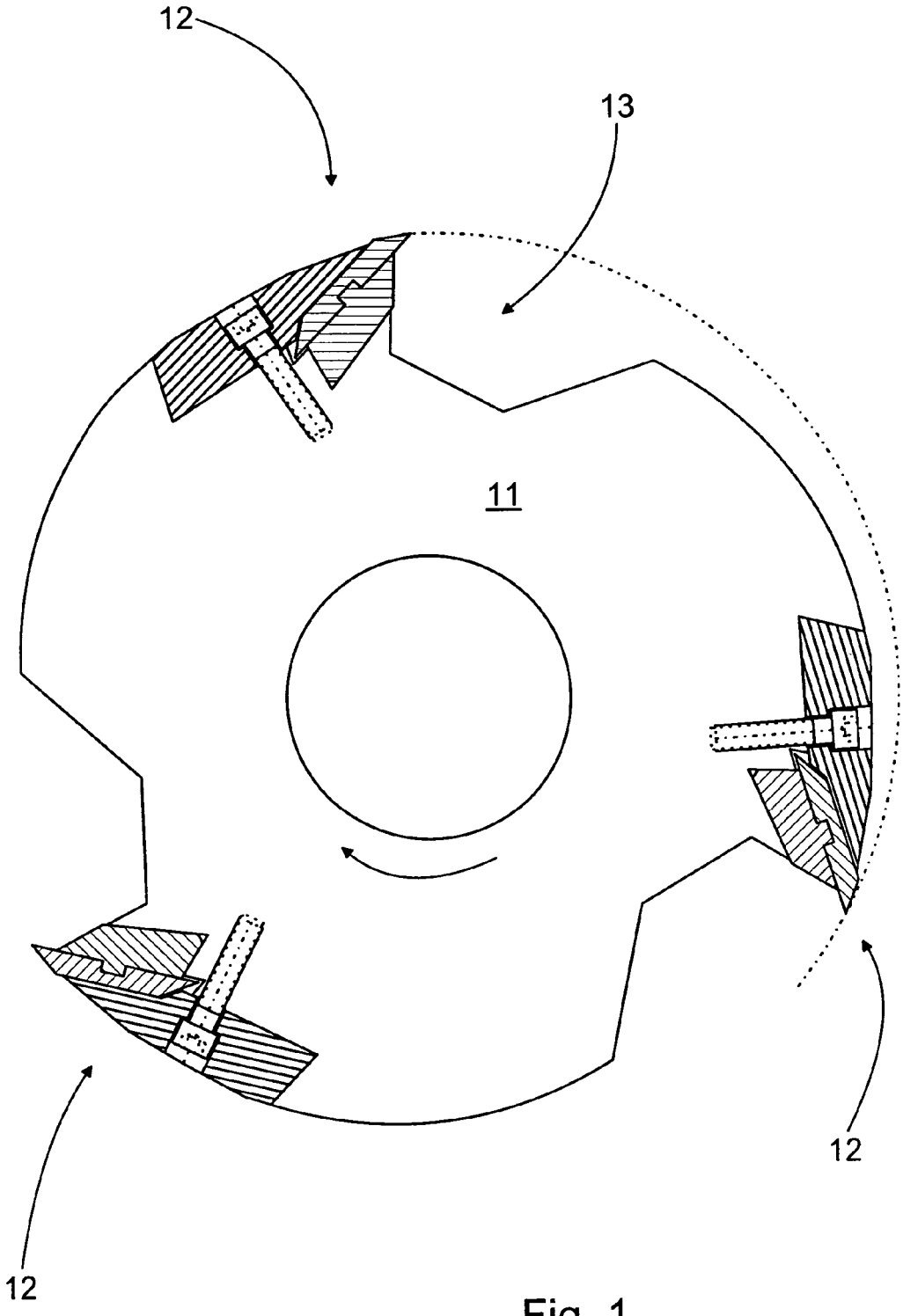
FIG. 1 shows the knife frame 11 of a drum chipper that is as such conventional, to which three knife assemblies 12 according to the invention are fitted. The knife frame 11 rotates in the direction shown by the arrow and is supported by other structures, which are not shown here. The same reference numbers are used for components that are operationally similar. In addition, in front of each knife assembly 12 in the direction of rotation, a sawdust pocket 13 is arranged, with space for the chips detached by the knife assembly 12. The knife assembly according to the invention suits all types of chipper, both fixed and mobile.
Figure 2A:
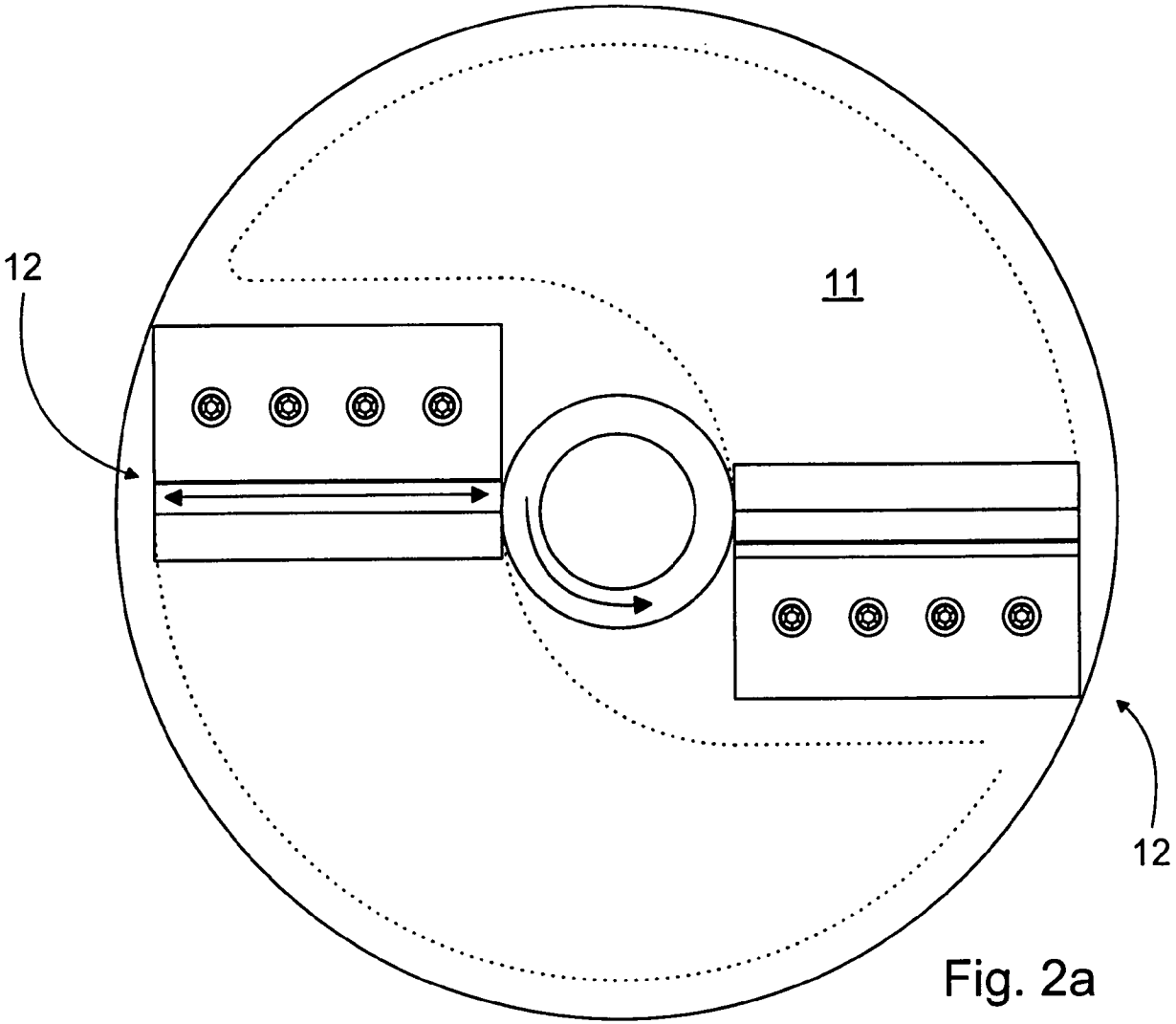
FIGS. 2*a* and 2*b* show the knife frame 11 of a so-called disc chipper, in which the knife assembly 12 is attached to the frontal surface of the knife frame 11. The chips then exit through an opening in the knife frame 11. In addition, the knife assembly according to the invention can also be used in log cant chippers used in sawmills, in which the reversible knives are attached to a conical knife frame. In the plank trimming chippers also used in sawmills, the knife assemblies are often set at an angle to the axis of rotation of the knife frame. The diameter of the knife frames described is about 350 mm. By altering the dimensioning, the knife assembly according to the invention can also be used in routers, even down to handtool-size.
Figure 2B:
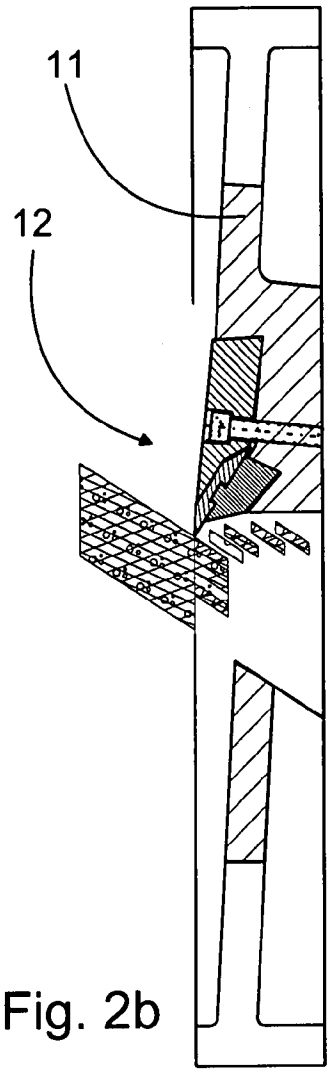

The reversible knife 14 is secured in place with the aid of a clamp 15, which is arranged to press on the reversible knife 14 from the side opposite to the counter knife 16. The knife assembly 12 also includes securing means 17 for securing the clamp 15 and tightening it onto the knife frame 11. Here the securing means 17 comprise a sufficient number of screws. The reversible knife 14 is thus pressed between the clamp 15 and the counter knife 16 by tightening the screws, thus holding the reversible knife 14 in position. In addition, there is at least one locking piece 18, parallel to the axis of symmetry i.e. longitudinal axis, of the reversible knife 14, between the reversible knife 14 and the counter knife 16. The locking piece 18 also extends to both sides of the boundary surface 21 between the reversible knife 14 and the counter knife 16. This prevents lateral movement of the reversible knife 14 relative to the counter knife 16. The longitudinal direction of the reversible knife is shown by a double-headed arrow in FIG. 2*a.*

In the knife assembly according to the invention, the aforesaid reversible knife, counter knife, and locking piece are arranged in such a way that the position of the reversible knife relative to the knife frame can be set as desired in the lateral direction of the reversible knife. In other words, the reversible knife can be set in different positions in the knife assembly. The feature in question is explained later in detail. The locking piece according to the invention is generally arranged as a fixed part of the reversible knife or of the counter knife. In addition, shape-locking is surprisingly used to fit the counter knife to the knife frame. In order words, the counter knife is secured without the known screws. The counter knife can thus be changed rapidly without tools and without removing the clamp. In addition, conventional reversible knives can be used.

Figure 3B:
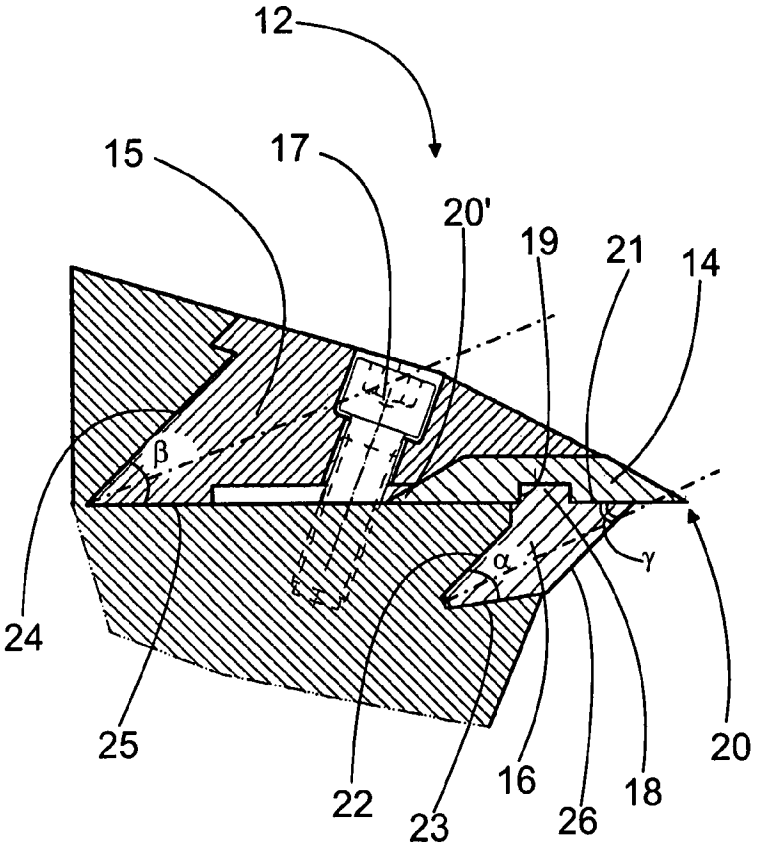
FIGS. 3*a* and 3*b* show in greater detail the knife assembly 12, according to the invention, which primarily includes a counter knife 16 fitted to the knife frame 12. The actual chipping member is an essentially symmetrical reversible knife 14, which is set against the counter knife 16. The reversible knife has two opposing cutting bevel edges 20, 20', allowing the reversible knife to be set in the knife assembly in two ways. One cutting bevel edge 20 protrudes further than the counter knife 16 from the knife frame 11, thus achieving the desired chipping effect. In practice, the reversible knife cuts chips from the material being chipped, which then strike the counter knife and break off (FIG. 2*b*).
Figure 3A:
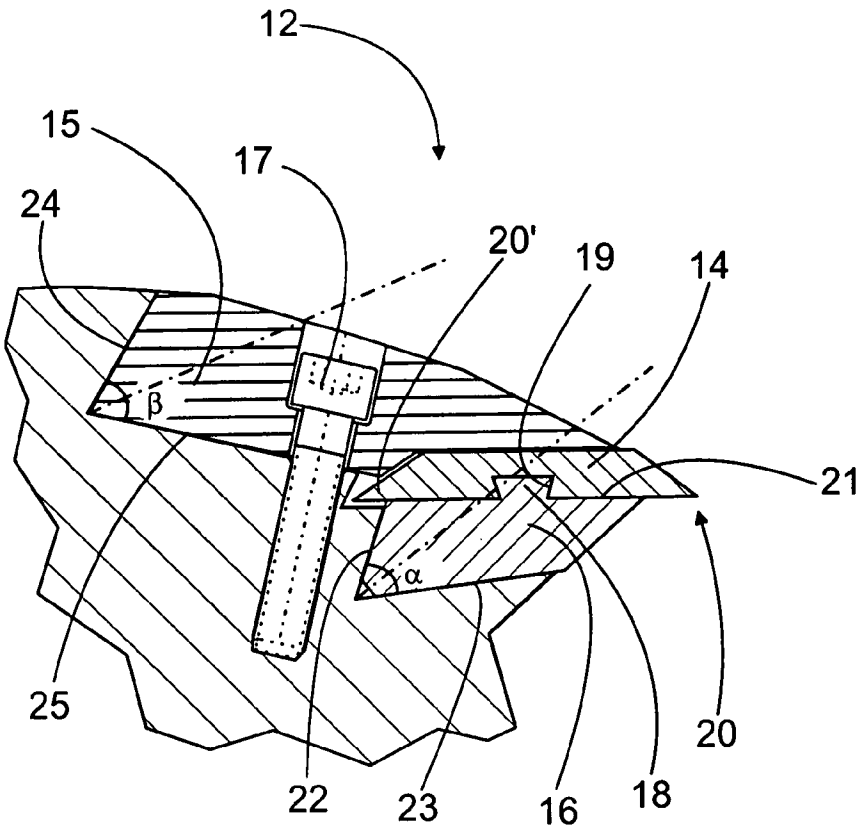

In the knife assembly shown in the figures, the locking piece 18 is arranged in the counter knife 16. The reversible knife 14, which is thus conventional, has a groove 19 in it corresponding to the locking piece. According to the invention, the locking piece is wider in the lateral direction of the reversible knife than it is high. This makes the locking piece considerably stronger than in the prior art. In addition, this avoids narrow grooves, which easily become blocked with sawdust. The simple construction means that the reversible knife is solidly supported. In FIG. 3*b*, the reversible knife 14 is arranged to be supported by both the knife frame 11 and the counter knife 16. The counter knife and the clamp are generally arranged to be supported directly on the knife frame. Thus part of the load acting on the reversible knife is transmitted directly to the knife frame. In addition, the knife frame 11 and the counter knife 16 together form an essentially flat support surface for the reversible knife in the embodiment of FIG. 3*b*. In addition, as the second end of the clamp is also supported on the said support surface, the shapes to be machined in the knife frame are simple and can be made with simple tools. In the embodiment of FIG. 3*a*, the reversible knife 14 is supported on the knife frame 11 by only the counter knife 16. This prevents suspension of the rear of the reversible knife relative to the knife frame, due to possible depression of the counter knife.

According to the invention, the counter knife is thus attached to the knife frame without the conventional screws. This is permitted by the mutual shaping of the knife frame, clamp, and counter knife. Together these components hold the reversible knife precisely in place while also themselves being held in place by screws. In practice, the loading of the reversible knife actually only tightens the shape-locking. When changing the reversible knife, it is enough to loosen the screws, when the reversible knife can be pulled out longitudinally and put back after being turned around. According to FIGS. 3*a* and 3*b*, the counter knife 16 has two counter-surfaces 22 and 23, arranged to correspond to the knife frame 11, which are arranged to form an acute angle $\alpha$. Generally the angle $\alpha$ is 25-75°, preferably 35-70°. Correspondingly, the clamp 15 has two counter-surfaces 24 and 25, arranged to correspond to the knife frame 11, which are arranged to form an acute angle $\beta$. Generally the angle $\beta$ is 40-85°, preferably 45-75°. Thus, both the counter knife and the clamp are types of wedges, which create an advantageous locking effect. At the same time, for example, the counter knife will remain securely in place, despite having no screws. FIGS. 3*a* and 3*b* use broken lines to show the bisectors of the aforesaid angles. According to the invention, the angle between the bisectors of the angles $\alpha$ and $\beta$ is maximum 20°. In FIG. 3*b*, the bisectors are nearly parallel. Thus the various components tighten in the same direction, which helps to eliminate looseness.

Figure 4A:
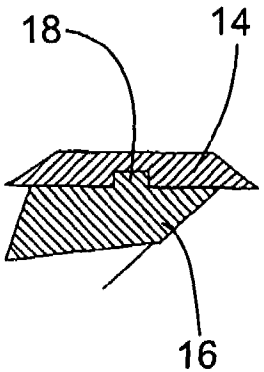
Figure 4B:
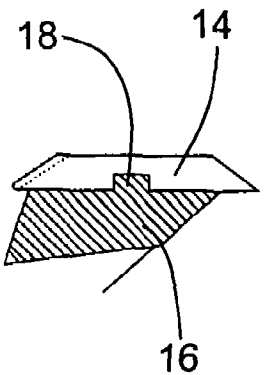
Figure 4C:
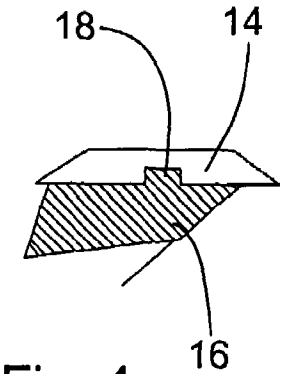
Figure 4D:
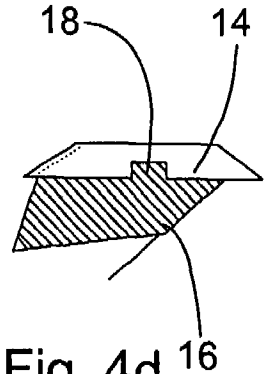
Figure 4E:
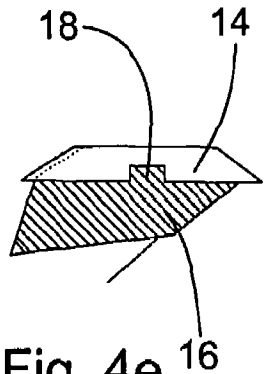
Figure 4F:
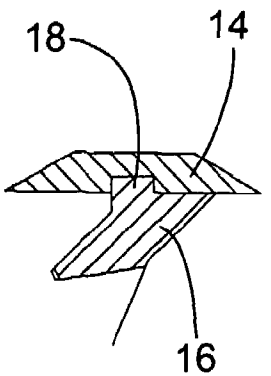
Figure 4G:
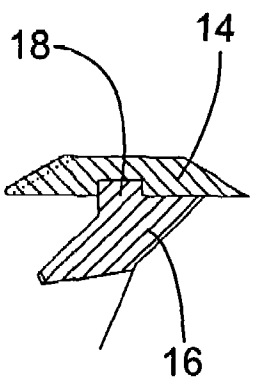
Figure 4H:
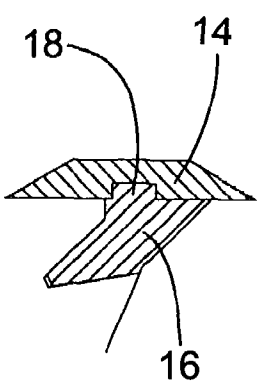
Figure 4I:
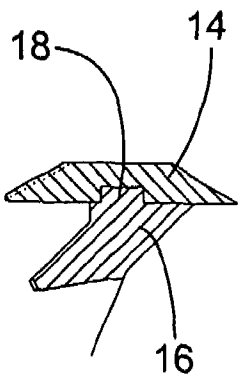
Figure 4J:
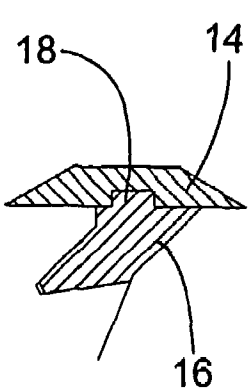

The reversible knives according to the invention are also sharpened. A single reversible knife can then be used for a considerably longer time than a conventional knife, which is advantageous in terms of total cost. The movement of the cutting bevel edge that occurs when the reversible knife is sharpened is compensated for using a counter-knife series according to the invention. Both cutting bevel edges of the reversible knife are thus arranged to be resharpenable. For this purpose, the knife series includes a corresponding counter knife for each sharpened reversible knife. Thus, the position of the sharpened cutting bevel edge can be altered to remain the same, relative to the knife frame, as it was prior to sharpening. Similarly, a wide locking piece can be used, when it is part of the changeable counter knife. FIGS. 4*a-d* show one series of counter knives for the knife assembly. FIGS. 4*f-j* show a second series of counter knives. The counter knives are mutually similar in other respects, except that the position of the protruding locking piece varies in the lateral direction of the reversible knife. This compensates for the movement of the cutting bevel edge caused by sharpening. It is then possible to sharpen a single reversible knife according to the example four times and in practice even more, depending mainly on the sharpening and the reversible knife. For example, in each sharpening, 0.5 mm of material is removed from each cutting bevel edge, so that in four sharpenings the reversible knife will narrow by 4 mm. In practice, the counter knife and the locking piece are dimensioned according to each type of reversible knife and sharpening method. Generally, the series of counter knives includes 1-6, preferably 2-5 different counter knives. Thus, the position of the reversible knife changes by 0.5-1.5 mm, preferably 0.8-1.2 mm, its lateral direction, after each sharpening. The worn cutting bevel edge and the sharpening tolerance (broken line) are shown in FIGS. 4*b*, 4*d*, 4*g*, and 4*i*. The movement of the locking piece appears most clearly in FIGS. 4*f-j*, in FIGS. 4*f* and 4*g* of which the counter knife is the same when the reversible knife is reversed. FIGS. 4*h* and 4*i* show a second counter knife of the counter-knife series while FIG. 4*j* shows a third counter knife.

The use of a changeable counter knife also brings other advantages. The counter-knife series according to the invention includes at least one second counter-knife series containing a corresponding number of counter knives. In the second counter-knife series, the angle $\gamma$ of the counter bevel edge and/or its distance from the cutting bevel edge is different to that of the first counter-knife series. This allows the shape and length of the chip to be altered by changing the counter knife. In other words, the operation of the chipper can be adjusted to suit each material being chipped and the operating conditions. For example, different knife settings are used for softwoods in winter and in summer. Correspondingly, there are different settings for hardwoods and softwoods. The angle $\gamma$ and the counter bevel edge are shown in FIG. 3*b*.

The wedge-like construction of the counter knife and the clamp means that both the reversible knife and the counter knife can be easily changed by loosening the screws. In addition, the reversible knife can be easily put back into the knife assembly, thanks to the broad and fixed locking piece. As is known, the reversible knife wears in use. The clamp and the counter knives, on the other hand, will last for a very long time. Thus the same clamp and counter-knife series can be used for a long time in the same position with the same kind of reversible knives. The clamp and counter knife are preferably precipitation-hardened cast or rolled pieces, allowing durable and dimensionally precise pieces to be obtained in one operation. The relatively small counter knife 16 shown in FIG. 3*b* is easily and economically made by casting. Correspondingly, the larger counter knife 16 shown in FIG. 3*a* has a simple shape, so that it can be successfully manufactured by rolling. The transmission of force to the knife frame can be assisted by arranging the locking piece to be shape-locked to the counter knife (FIG. 3*a*). The force tending to open the reversible knife is then partly transmitted through the counter knife to the knife frame, thus reducing the load on the clamp. At the same time, the reversible knife is prevented from detaching from the counter knife. In FIG. 3*a*, the shape-locking is implemented using a dovetail joint.

The use of the knife assembly according to the invention saves materials costs, as the reversible knives can be sharpened many times. The considerable shortening of installation time due to easier knife changing is also important. Further, the characteristics of the knife assembly can be easily adjusted and the knife assembly can be applied to the attachment of many different kinds of reversible knife.

Although the invention has been described by reference to specific embodiments, it should be understood that numerous changes may be made within the spirit and scope of the inventive concepts described. Accordingly, it is intended that the invention not be limited to the described embodiments, but that it have the full scope defined by the language of the following claims.

The invention claimed is:

1. A knife assembly for a chipper, which is intended to be installed in a knife frame that forms part of the chipper, said knife assembly comprising:

a counter knife fitted to the knife frame;

an essentially symmetrical reversible knife set against the counter knife, the reversible knife including two cutting bevel edges disposed at opposite sides of the reversible knife, one of the cutting bevel edges extending further than the counter knife from the knife frame;

a clamp for pressing the reversible knife against a side opposite the counter knife;

securing means for securing and tightening the clamp onto the knife frame and thus for pressing the reversible knife between the clamp and the counter knife; and at least one locking piece, which is parallel to a longitudinal axis of the reversible knife and extends on both sides of a boundary surface between the reversible knife and the counter knife, for preventing lateral movement of the reversible knife relative to the counter knife, the at least one locking piece forming an integral part of the reversible knife or the counter knife;

the reversible knife, the counter knife, and the locking piece being arranged in such a way that the position of the reversible knife relative to the knife frame is set as desired in a lateral direction of the reversible knife;

the counter knife having two counter-surfaces arranged to rest on the knife frame, the counter-surfaces forming an acute angle $\alpha$ in the range of 25-75°, for fitting the counter knife to the knife frame using shape-locking.

2. A knife assembly according to claim 1, characterized in that the clamp has two counter-surfaces resting on the knife frame, the counter-surfaces forming an acute angle $\beta$ in the range of 40-85°.

3. A knife assembly according to claim 2, characterized in that an angle between bisectors of angles $\alpha$ and $\beta$ is a maximum of 20°.

4. A knife assembly according to claim 1, characterized in that the locking piece is an integral part of the counter knife, a groove corresponding to the locking piece is arranged in the reversible knife, and the width of the locking piece in the lateral direction of the reversible knife is greater than the height of the locking piece.

5. A knife assembly according to claim 1, characterized in that the counter knife and the clamp are supported directly on the knife frame.

6. A counter-knife series for a knife assembly including, a counter knife fitted to a knife frame of a chipper, an essentially symmetrical reversible knife set against the counter knife, the reversible knife including two cutting bevel edges disposed at opposite sides of the reversible knife, one of the cutting bevel edges extending further than the counter knife from the knife frame, a clamp, for pressing the reversible knife against a side opposite the counter knife, securing means for securing and tightening the clamp onto the knife frame and thus for pressing the reversible knife between the clamp and the counter knife, and at least one locking piece, which is parallel to a longitudinal axis of the reversible knife and extends on both sides of a boundary surface between the reversible knife and the counter knife, for preventing lateral movement of the reversible knife relative to the counter knife, the at least one locking piece forming an integral part of the reversible knife or the counter knife, the reversible knife, the counter knife, and the locking piece of the knife assembly being arranged in such a way that the position of the reversible knife relative to the knife frame is set as desired in a lateral direction of the reversible knife, the counter knife having two counter-surfaces resting on the knife frame, the counter-surfaces forming an acute angle $\alpha$ in the range of 25-75°, for fitting the counter knife to the knife frame using shape-locking, and both cutting bevel edges of the reversible knife being arranged so that the cutting bevel edges are sharpenable, the counter-knife series comprising a corresponding counter knife for each sharpened reversible knife, in order to adapt the position of the sharpened cutting bevel edge relative to the knife frame, to be the same as the cutting bevel edge was prior to sharpening.

7. A counter-knife series according to claim 6, characterized in that the counter-knife series includes 1-6 different counter knives for changing the position of the reversible knife by 0.5-1.5 mm in the lateral direction of the reversible knife, after sharpening.

8. A counter-knife series according to claim 6, characterized in that the counter-knife series includes at least one second counter-knife series including a corresponding number of counter knives, in which the angle $\gamma$ of the counter bevel edge of the counter knives and/or the distance of the cutting bevel edge from the counter bevel edge are different to those in the first counter-knife series.

9. A counter-knife series according to claim 6, characterized in that the counter knives are precipitation-hardened cast pieces or rolled pieces.

* * * * *